US005423176A

United States Patent [19]

Stahlecker et al.

[11] Patent Number: 5,423,176

[45] Date of Patent: Jun. 13, 1995

[54] OPENING ROLLER RING MEMBER FOR OPEN-END SPINNING MACHINE

[75] Inventors: Fritz Stahlecker, Josef-Neidhart-Strasse 18, 73337 Bad Ueberkingen; Gerd Stahlecker, Auf der Ebene 30, 73054 Eislingen, both of Germany

[73] Assignees: Fritz Stahlecker, Bad Ueberkingen; Gerd Stahlecker, Eislingen, both of Germany

[21] Appl. No.: 177,514

[22] Filed: Jan. 4, 1994

[30] Foreign Application Priority Data

Jan. 12, 1993 [DE] Germany ..... 43 00 536.5

[51] Int. Cl.[6] ..... D01H 4/00

[52] U.S. Cl. ..... 57/408; 19/112; 19/114

[58] Field of Search ..... 19/112, 114; 57/408, 57/412

[56] References Cited

U.S. PATENT DOCUMENTS 4,805,395 2/1989 Stahlecker et al. ..... 19/112 X
4,833,757 5/1989 Stahlecker ..... 57/408 X
4,858,275 8/1989 Stahlecker et al. ..... 57/408 X
4,882,812 11/1989 Fetzer et al. ..... 19/112

FOREIGN PATENT DOCUMENTS 3827334 2/1990 Germany .

*Primary Examiner*—Daniel P. Stodola
*Assistant Examiner*—William Stryjewski
*Attorney, Agent, or Firm*—Evenson McKeown Edwards & Lenahan

[57] ABSTRACT

In the case of an opening roller ring member for spinning machines, teeth are integral with a ring-formed base body, the teeth being bounded by notches which extend essentially in axial direction, and by grooves which extend essentially in circumferential direction. The grooves are deeper than the notches. The lateral flanks of the teeth extend towards the tooth tip with a slope angle towards the radial line. The slope angle of the lateral flanks is smaller than the slope angle of the continuous lateral walls of the grooves, at least in the area of the teeth tips. There is a bend in the slope angle of the side walls of the grooves where the side walls join the slope angle of the lateral flanks, whereby the bend edge either coincides with the transition of the side walls into the lateral flanks, or is situated in the area of the lateral flanks.

28 Claims, 3 Drawing Sheets

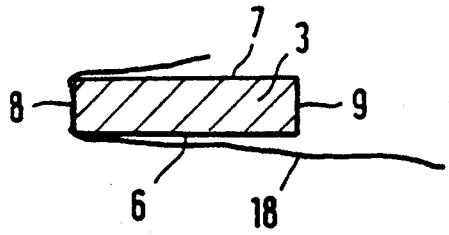
FIG. 5
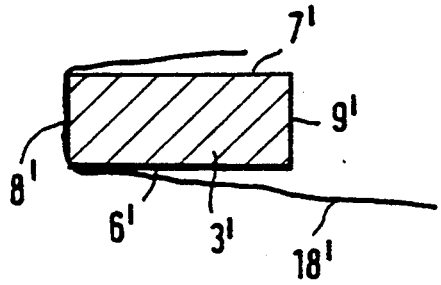
FIG. 6
FIG. 7
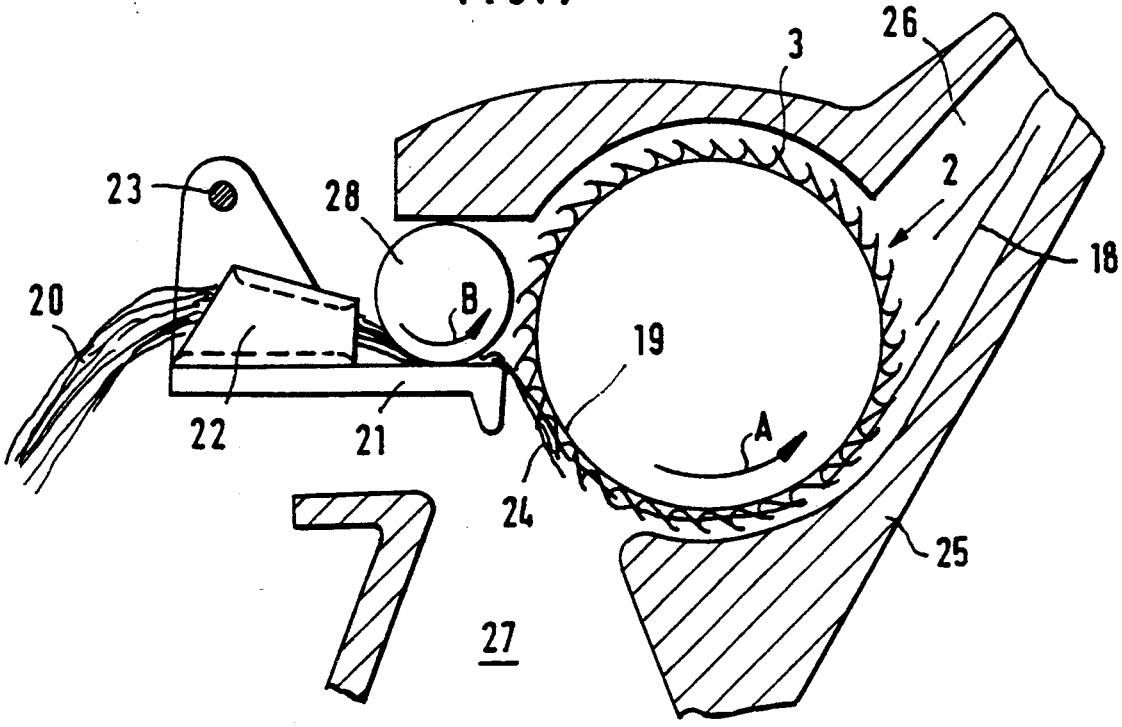

OPENING ROLLER RING MEMBER FOR OPEN-END SPINNING MACHINE

BACKGROUND AND SUMMARY OF THE INVENTION

The invention relates to an opening roller ring member for open-end spinning machines, which is provided around its circumference with integral single teeth, whose tooth faces and tooth backs are bounded by notches extending essentially in axial direction, and whose lateral flanks are bounded by grooves extending essentially in circumferential direction, the grooves being deeper than the notches, so that the lateral flanks join the continuous lateral walls of the grooves, the lateral flanks each tapering off into the tooth tip and each having a slope angle towards the radial line.

The design of the fitting of the opening roller has a great influence on the quality of open-end spinning. By means of the opening roller, delivered fiber material, in the form of a sliver is separated into single fibers, which are then transported to a spinning element. The function of the opening roller is, on the one hand, to achieve a near as possible complete separation of the fiber material into single fibers, and on the other hand to ensure that the fibers are damaged as little as possible, in particular that they are not shortened. Furthermore the fitting must be designed in such a way that the fibers, after a pre-set transport path along the circumference of the opening roller, can be released from the teeth and transported by a fiber feed channel to the spinning element.

Ring members of the type already mentioned are known from German patent application DE 38 27 344 Al. A set of teeth is worked (machined) out of the outer circumference of the ring-shaped base body, the teeth being bounded by notches extending essentially in axial direction, and by grooves extending essentially in circumferential direction. The grooves are deeper than the notches. This difference in depth is designed to improve the fiber transport while simultaneously resulting in an improved fiber-detaching at the delivery point. The lateral flanks of the teeth extend in a straight line to the lateral walls of the grooves.

An object of the invention is to further improve the already known tooth form and to guarantee on the one hand a good combing-out of the sliver into single fibers and on the other hand to ensure that the fibers are easily detached from the fitting at the designated place.

This object is achieved according to preferred embodiments of the invention in that the slope angle of the lateral flanks of the teeth is smaller than the slope angle of the lateral walls of the grooves, at least in the area of the teeth tips.

According to the invention, the teeth—in longitudinal sections—are therefore in the area of the teeth bases significantly wider than in the area of the teeth tips. This significant tapering at the teeth tips ensures that the sliver is separated well into single fibers. The increased slope angle of the lateral walls of the grooves in the area of the teeth bases supports the centrifugal force effect for the fiber delivery, for example at the entry to a fiber feed channel. The larger the angle of inclination is, the easier the fibers are detached from the fitting, and undesirable circulating fibers can be avoided which have a reducing effect on quality. The size of the slope angle is optimized through tests, so that it doesn't result in a premature detaching of the fibers from the fitting, for example in the area of a trash removal opening.

What is more, due to the increased face width of the tooth, as in accordance with the invention, there is less wear because the fibers which cause the wear lie on a larger surface.

The slope angle of the lateral walls and the lateral flanks can decrease gradually towards the teeth tips. From the point of view of an advantageous production, however, it is better when the slope angle of the lateral walls of the grooves joins the slope angle of the lateral flanks at a bend. This can occur with a more or less large radius on the bend edge.

In a first version the bend edge coincides with the joining of the lateral walls with the lateral flanks. This means that the slope angle changes dramatically at that point where the lateral flanks of the individual teeth join the continuous lateral walls of the grooves. In a second version, the bend edge is in the area of the lateral flanks. The latter version results in an even better detaching of the fibers from the fitting; however the danger exists that in certain circumstances the fibers can detach themselves prematurely from the fitting. The position of the bend edge depends on the prevailing conditions, for example, the diameter and the revolutions per minute of the opening roller, or the fiber material to be spun. The tooth height is also a deciding factor.

In an advantageous development of the invention it is intended that the slope angle of the teeth flanks and the lateral walls of the grooves is constant, with the exception of a radius of curvature in the groove base. This facilitates production on the one hand, while on the other hand providing for a division in spinning functions in the area of the teeth, namely in one area the good combing-out effect at the teeth tips, and in the other a facilitating of the detaching of fibers.

In an advantageous development of the invention it is provided that the slope angle of the lateral flanks of the teeth and the lateral walls of the grooves extend symmetrically to the radial line.

This results in the fibers, which have been transported from the fitting, being processed equally on each lateral flank of the teeth. This ensures an improved uniformity in the separation of the fibers.

The slope angle of the lateral flanks of the teeth tapers off advantageously into a narrow tooth tip of maximum 0.2 mm in length. The fitting is therefore very aggressive, and so ensures a good combing-out effect during separation of the sliver into single fibers.

To this purpose, the slope angle of the lateral walls of the grooves is three to six times the slope angle of the lateral flanks of the teeth. Hereby in particular is taken into account that the area of the tooth tips is left unchanged, in comparison to traditional tried and tested fittings, and the improved detaching of the fibers from the fitting is transferred to the area of the tooth bases in particular.

Preferably, the slope angle of the lateral flanks of the teeth should be 4° in dimension to the radial line. This design has proved itself in particular for teeth which have been cut out of a ring-shaped base body. The slope angle of the lateral walls of the grooves can therefore be most advantageous at a dimension of 15° to 22° to the radial line. This still allows for a favorable joining of the groove bases wit two neighboring teeth.

In especially preferred embodiments, it is provided that the grooves are 1.4 to 1.7 times the depth of the notches. Due to this form, those fibers which wrap themselves around the tooth face do not advance down into the groove bases. At the same time, however, a larger surface is provided for those fibers which do get into the grooves, from which a taking-along is made possible by friction.

In a further development of the invention it is provided that the distance between the bend edge to the groove base—measured from the tooth tip—is 0.4 to 0.7 times the depth of the grooves. This design has resulted from tests of various embodiments of the invention. It is hereby advantageous when the lateral flanks of two neighboring teeth are connected together through a constant radius of curvature, which measures between 0.5 to 0.6 mm in the area of the groove bases.

Other objects, advantages and novel features of the present invention will become apparent from the following detailed description of the invention when considered in conjunction with the accompanying drawings.

BRIEF DESCRIPTION OF THE DRAWINGS

FIG. 5 is a section length of the section surface V—V of FIG. 3;

FIG. 6 is a section length of the section surface VI—VI of FIG. 4; and

FIG. 7 is a partial sectional side view off an open-end spinning aggregate in the area of the opening roller.

DETAILED DESCRIPTION OF THE DRAWINGS

Figure 1:
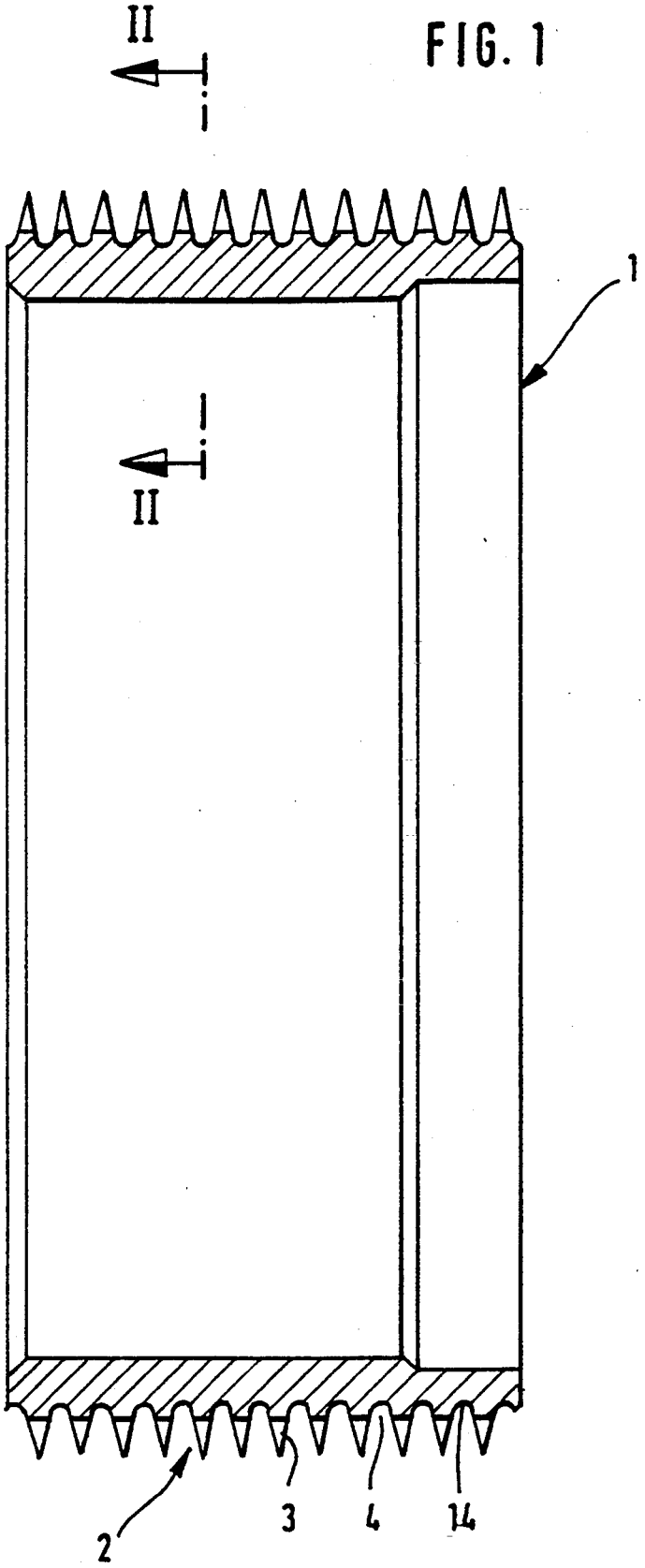
FIG. 1 is a longitudinal sectional view through an opening roller ring member constructed according to a preferred embodiment of the invention.
Figure 2:
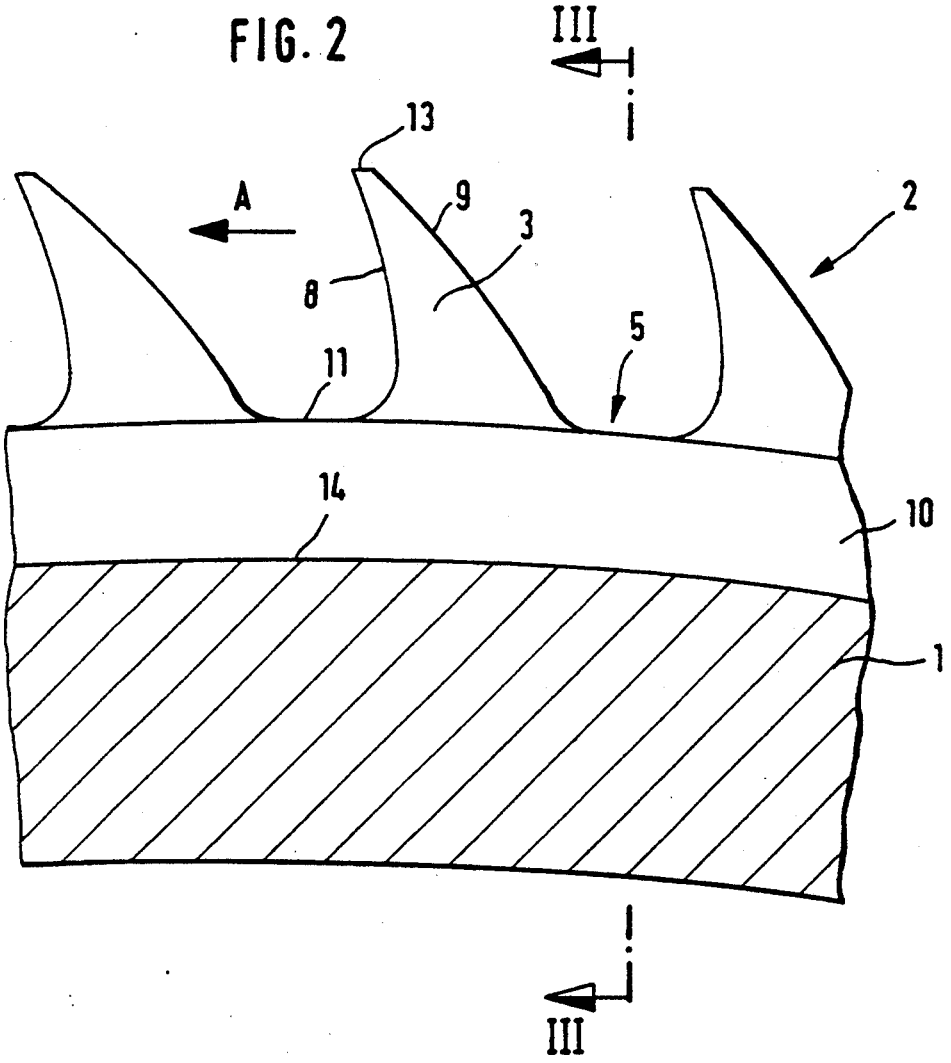
FIG. 2 is a greatly enlarged radial section through the opening roller ring member in the area of the teeth relating to the section surface II—II of FIG. 1.
Figure 3:
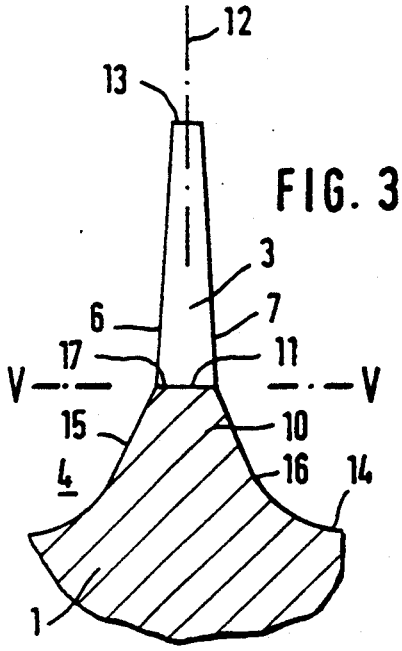
FIG. 3 is a longitudinal sectional view, equally enlarged, through the opening roller ring member of the invention in the area of the teeth relating to the section surface III—III of FIG. 2.

The opening roller ring member t in FIGS. 1 to 3 is provided on its outer circumference with a fitting 2 of teeth 3, which have been worked out of the opening roller ring member 1 by means of a cutting process. This is done by grinding after the opening roller ring member 1 has been heat-treated. Thus the teeth 3 are integral with the base body of the ring member 1.

Grooves 4 are worked into the outer circumference of the opening roller ring member 1, which extend essentially in circumferential direction. These grooves 4 are worked into the outer circumference so that they form a helix with a low gradient.

There are also many notches 5 worked into the outer circumference and extending in axial direction. The grooves 4 border the teeth 3 of the mounting in relation to the lateral flanks 6 and 7. The notches 5 border the teeth 3 in relation to the tooth face 8 and the tooth back 9. As can be seen in FIG. 2, the tooth face 8 of the teeth 3 is bent forwards in relation to the direction of rotation A, in such a manner that the teeth 3 in the area of the teeth bases 11 start with an almost radially arranged tooth face 8, which extending outwards, slopes forward to quite a degree. The transition from the tooth back 9 of the preceding tooth 3 to the tooth face 8 of the following tooth 3 is evenly rounded off with a radius.

The lateral flanks 6 and 7 of the teeth 3 extend with a slope angle to the radial line 12, whereby in extending outwards towards the tooth tip 13, they approach one another. The tooth tip 13 is somewhat flattened.

In the area of the tooth base 11, the lateral flanks 6 and 7 join the lateral walls 15 and 16 of the grooves 4, which have a groove base 14, which is rounded off with a large radius. It can be seen that the grooves 4 in radial direction are noticeably deeper than the notches 5.

As can be seen from FIG. 3, the lateral walls 15 and 16 of the grooves 4 opposite the radial line 12 are more inclined than the lateral flanks 6 and 7 of the teeth 3. The slope angle of the lateral walls 15 and 16 joins the smaller slope angle of the lateral flanks 6 and 7 at a bend, which coincides with the joining of the lateral walls 15 and 16 and the lateral flanks 6 and 7. Thereby it is ensured that in particular the fibers in the grooves 4 can be easily detached from the fitting. The smaller slope angle of the lateral flanks 6 and 7 in the area of the tooth tip 13 guarantees however, that a good combing-out effect is achieved by which a sliver is separated into single fibers.

Figure 4:
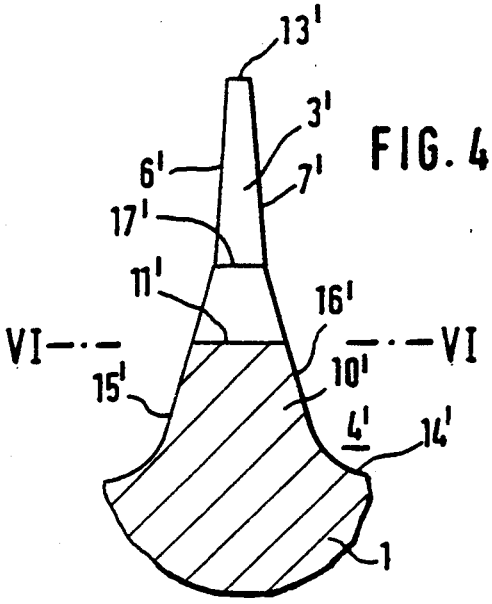
FIG. 4 is a longitudinal section similar to FIG. 3 in another version of the invention.

In another version as shown in FIG. 4, the beginning of the tooth base 11' does not coincide with the bend edge 17', where the lateral walls 15' and 16' of the grooves 4' join the lateral flanks 6' and 7' of the teeth 3', but rather the bend edge 17' is positioned further towards the tooth tip 13'. This not only results in an even more improved releasing of the fibers from the teeth 3', but also ensures that in,the area of the tooth base 11', wear is reduced due to the fact that the cross section at this point is enlarged. It has been proved in practice that particularly in the area of the tooth base 11 and 11', wear of the fitting 2 is especially bad.

As is clear from FIGS. 5 and 6 in particular the tooth face 8' in the area of the tooth base 11' according to FIG. 4 is noticeably wider than the tooth face 8 in the area of the tooth base 11 according to FIG. 3. A fiber 18' at a tooth 3' in the area of the tooth base 11' has, therefore, according to FIGS. 4 and 6, a larger contact surface than a fiber 18 at a tooth base 11 according to FIGS. 3 and 5.

As can be further seen in FIGS. 3 and 4, the slope angle of the lateral walls 15 and 16 of the grooves 4 and the lateral walls 15' and 16' of the grooves 4' is, aside from the respective rounding on the groove base 14, 14', constant. In addition it can be seen that the teeth 3 and 3' in relation to the radial line 12 are completely symmetrical. They approach one another in a narrow tooth tip 13 and 13' of maximum 0.2 mm in length.

The opening roller ring member 1 described up to this point can be mounted onto an opening roller 19 according to FIG. 7. The opening roller 19 is used to separate a sliver 20 into single fibers 18. The sliver 20 is presented in the form of a fiber beard 24 by a driven feed roller 28 rotating in arrow direction B, to a significantly faster rotating opening roller 19, rotating in arrow direction A. The separation into Single fibers 18 then takes place.

The feed roller 28, together with a spring-mounted feed table 21 pressed close to it, forms a nipping line. The feed table 21, which is hinged by means of a fixed axle 23, has in addition a condensor 22.

The circumference of the opening roller 19 is to a large extent surrounded by an opening roller housing 25, which is designed to fit the shape of the opening roller 19.

A fiber feed channel 26 begins approximately diametrically opposite the feed roller 28 in the opening roller housing 25. In this area the fibers 18 must be detached from the fitting 2. This is made easier by the invention. However, attention must be paid that fibers are not released beforehand into the area of the trash removal opening 27.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Opening roller ring member for open-end spinning installations having teeth projecting outwardly from an outer circumference of the ring member and being integral with the ring member, each tooth having a tooth face which faces a rotational direction of the ring member during use thereof, a tooth back, a tooth tip, and two lateral flanks extending radially inwardly of the ring member from the tooth tip, wherein grooves are provided which extend circumferentially around the ring member at a position adjacent to and radially inwardly of the teeth lateral flanks, each of said grooves having a pair of respective lateral walls which extend essentially radially outwardly of the ring member from groove bottoms to radial inward ends of respective lateral flanks of respective circumferentially adjacent teeth, said teeth lateral walls and groove lateral flanks together forming continuous essentially radially extending lateral edges of the teeth, wherein, said lateral flanks and said lateral walls for each tooth are sloped respective slope angles with respect to a radial plane of the ring member through the respective tooth so as to approach one another in a direction toward the respective tooth tip, and wherein the slope angles of the lateral flanks at least near to the teeth tips are smaller than the slope angles of the lateral walls.

2. An opening roller ring member according to claim 1, wherein the slope angle of the lateral walls of the grooves joins the slope angle of the lateral flanks at a bend edge.

3. An opening roller ring member according to claim 2, wherein the bend edge coincides with a juncture of the lateral walls with the lateral flanks.

4. An opening roller ring member according to claim 3, wherein, with the exception of a radius of curvature in the groove base, each slope angle of the lateral flanks of the teeth and the lateral walls of the grooves is constant over the extent of the respective lateral flanks and lateral walls.

5. An opening roller ring member according to claim 4, wherein the slope angle of the lateral flanks and the slope angle of the lateral walls extend symmetrically towards the radial plane.

6. An opening roller ring member according to claim 3, wherein the slope angle of the lateral walls is three to six times the slope angle of the lateral flanks.

7. An opening roller ring member according to claim 2, wherein the bend edge is positioned in an area of the lateral flanks.

8. An opening roller ring member according to claim 7, wherein, with the exception of a radius of curvature in the groove base, each slope angle of the lateral flanks of the teeth and the lateral walls of the grooves is constant over the extent of the respective lateral flanks and lateral walls.

9. An opening roller ring member according to claim 8, wherein the slope angle of the lateral flanks and the slope angle of the lateral walls extend symmetrically towards the radial plane.

10. An opening roller ring member according to claim 9, wherein the slope angle of the lateral flanks taper off into a narrow tooth tip of maximum 0.2 mm in length in an axial direction of the ring member.

11. An opening roller ring member according to claim 10, wherein the slope angle of the lateral walls is three to six times the slope angle of the lateral flanks.

12. An opening roller ring member according to claim 11, wherein the slope angle of the lateral flanks of the teeth measures 4° to the radial line.

13. An opening roller ring member according to claim 12, wherein the slope angle of the lateral walls of the grooves measures from 15° to 22° to the radial line.

14. An opening roller ring member according to claim 13, wherein the depth of the grooves are 1.4 to 1.7 times the depth of notches bounding respective adjacent teeth and extending in an axial direction of the ring member.

15. An opening roller ring member according to claim 14, wherein the distance from the bend edge to the groove base—measured from the tooth tips—is 0.4 to 0.7 times the depth of the grooves.

16. An opening roller ring member according to claim 15, wherein the radius of curvature of the groove base measures between 0.5 to 0.6 mm.

17. An opening roller ring member according to claim 7, wherein the slope angle of the lateral walls is three to six times the slope angle of the lateral flanks.

18. An opening roller ring member according to claim 2, wherein the distance from the bend edge to the groove base—measured from the tooth tips—is 0.4 to 0.7 times the depth of the grooves.

19. An opening roller ring member according to claim 2, wherein the slope angle of the lateral flanks taper off into a narrow tooth tip of maximum 0.2 mm in length in an axial direction of the ring member.

20. An opening roller ring member according to claim 1, wherein, with the exception of a radius of curvature in the groove base, each slope angle of the lateral flanks of the teeth and the lateral walls of the grooves is constant over the extent of the respective lateral flanks and lateral walls.

21. An opening roller ring member according to claim 20, wherein the radius of curvature of the groove base measures between 0.5 to 0.6 mm.

22. An opening roller ring member according to claim 1, wherein the slope angle of the lateral flanks and the slope angle of the lateral walls extend symmetrically towards the radial plane.

23. An opening roller ring member according to claim 1, wherein the slope angle of the lateral flanks taper off into a narrow tooth tip of maximum 0.2 mm in length in an axial direction of the ring member.

24. An opening roller ring member according to claim 1, wherein the slope angle of the lateral walls is three to six times the slope angle of the lateral flanks.

25. An opening roller ring member according to claim 24, wherein the slope angle of the lateral walls measures from 15° to 22° to the radial plane.

26. An opening roller ring member according to claim 1, wherein the slope angle of the lateral flanks measures 4° to the radial plane.

27. An opening roller ring member according to claim 26, wherein the slope angle of the lateral walls measures from 15° to 22° to the radial plane.

28. An opening roller ring member according to claim 1, wherein the depth of the grooves are 1.4 to 1.7 times the depth of notches bounding respective adjacent teeth and extending in an axial direction of the ring member.

* * * * *